United States Patent [19]

Cordell

[11] 4,350,904

[45] Sep. 21, 1982

[54] CURRENT SOURCE WITH MODIFIED TEMPERATURE COEFFICIENT

[75] Inventor: Robert R. Cordell, Tinton Falls, N.J.

[73] Assignee: Bell Telephone Laboratories, Incorporated, Murray Hill, N.J.

[21] Appl. No.: 189,045

[22] Filed: Sep. 22, 1980

[51] Int. Cl.[3] ..... H03K 3/26; H03K 17/60

[52] U.S. Cl. ..... 307/310; 307/255; 307/297; 307/299 A; 330/288

[58] Field of Search ..... 307/310, 255, 296, 297, 307/299 A; 330/288, 289; 323/315

[56] References Cited

U.S. PATENT DOCUMENTS

| | | | |
|---|---|---|---|
| 3,886,435 | 5/1975 | Steckler | 307/297 |
| 3,911,353 | 10/1975 | van de Plassche | 323/315 |
| 4,029,974 | 6/1977 | Brokaw | 307/310 |
| 4,123,698 | 10/1978 | Timko et al. | 307/299 B |
| 4,194,166 | 3/1980 | Sakai et al. | 330/288 |

OTHER PUBLICATIONS

RCA Tech. Notes, No. 949, "Current Mirror Amplifiers Having Current Gains Less Influenced by the Base Currents of Component Transistors", by J. Radovsky, 12/31/73, pp. 1-7.

Electronic Engineering, "The Design of Constant Current Sources", Jun. 1977, pp. 85-88.

*Primary Examiner*—Stanley D. Miller, Jr.
*Assistant Examiner*—B. P. Davis
*Attorney, Agent, or Firm*—Volker R. Ulbrich

[57] ABSTRACT

An integrated circuit current source (10) has first (16) and second (30) current mirrors regeneratively coupled. The transistors (32, 34) of the second mirror (30) have unequal current densities, so that a resistor (40) connected to the emitter of the lower current density transistor (34) establishes a temperature-dependent output current. One of the transistors (18, 20, 34) has its base and emitter connected together through a modifying resistor (42, 53, 55) to modify the temperature dependence of the output. In one embodiment (10), the modifying resistor (42) connects the base and emitter of the lower current density transistor (34) and increases the temperature dependence of the output to make it directly proportional to the absolute temperature. Other embodiments (52, 54) are disclosed for obtaining both zero and negative temperature coefficient values for the output.

12 Claims, 4 Drawing Figures

CURRENT SOURCE WITH MODIFIED TEMPERATURE COEFFICIENT

TECHNICAL FIELD

The invention relates to controlled current sources for integrated electronic circuits, particularly those using bipolar transistors.

BACKGROUND OF THE INVENTION

The transconductance of the transistors in integrated circuits decreases with increasing temperature of the substrate chip, largely as a result of decreasing carrier mobility. For circuits which must have good temperature stability, such as those used for measurements or certain timing functions, it is necessary to compensate for the change in the transconductance by correspondingly varying the bias current for the transistors. For this reason, there is a need for an integrated circuit transistor biasing sub-circuit with a reference current which varies as a function of the absolute temperature of the substrate. Such reference current can be generated in a current loop referred to as a PTAT (Proportional To Absolute Temperature) current source.

In a known type of current source, such as is described for example in U.S. Pat. No. 4,029,974 issued June 14, 1977 to Brokow and entitled "Apparatus for Generating a Current Varying with Temperature", a first, unity gain current mirror for supplying a current relatively independent of supply voltage fluctuations is connected head-to-tail, or input-to-output to a second, temperature-sensitive current mirror to form a regenerative current loop.

The first mirror has first and second PNP current transistors of matched junction areas with their emitters connected to a positive supply voltage through equal emitter resistors and with their bases connected together and tied to the collector of the second transistor. The second transistor is considered the input transistor, while the first transistor is considered the output transistor.

The second mirror has third, input and fourth, output NPN current transistors, with the fourth current transistor having a larger junction area than the third current transistor. The collectors of the first and third current transistors are connected together, as are the collectors of the second and fourth current transistors. The bases of the third and fourth current transistors are connected to each other and to the collector of the third current transistor. The emitter of the third current transistor is connected directly to a negative supply voltage, while the emitter of the fourth current transistor is connected to the negative supply voltage through a current-setting resistor which establishes the operating current for the loop.

With such an arrangement, the base-emitter current densities in the third and fourth current transistors of the second mirror will be unequal. The resulting difference between their base-emitter voltages will be proportional to the absolute temperature and will appear across the current-setting resistor.

It is a major shortcoming of the above-described type of current source that while the two equal emitter resistors for the first mirror can have their resistance vary with changes in temperature without thereby causing a significant change in the loop current, the resistance of the current-setting resistor connected between the emitter of the second mirror output transistor and the negative supply voltage must have a zero temperature dependence if the proportionality of the current to the absolute temperature is to be preserved.

Resistors which can be integrated into the circuit on the chip, however, typically have a temperature coefficient on the order of about +2000 ppm/°C. (parts per million per degrees Celsius). In comparison, at room temperature the ideal PTAT characteristic itself is on the order of +3300 ppm/°C. A current source as described above using such diffused resistors would thus have a net temperature coefficient of approximately 3300–2000=1300 ppm/°C., representing a deviation of over 60 percent from the desired PTAT characteristic. For this reason, in order to have reasonable adherence to the PTAT characteristic, it has been necessary to use an off-chip discrete resistor instead of an integrated one.

The provision of a current-setting resistor off-chip is undesirable, primarily because it requires the use of at least one terminal of the packaging for the chip. Such passive use of a terminal limits the extent to which the integrated circuit can be addressed actively for its available functions.

SUMMARY OF THE INVENTION

The shortcomings of the prior current sources as discussed above are substantially eliminated in the current source arrangement of the invention, which is of the type having first and second current mirrors connected head-to-tail to form a regenerative current loop. The first current mirror has first and second current transistors and the second current mirror has third and fourth current transistors. The current transistors of the second mirror have unequal current densities in their conductive junction areas and thereby generate a temperature-dependent current in a current-setting resistor connected to the emitter of the fourth current transistor, which has the larger junction area and therefore a lower current density in its conductive junction area. A modifying resistor connects together the base and emitter of one of the first, second, or fourth transistors and modifies the temperature dependence of the current of the associated transistor.

In one form of the invention, the modifying resistor connects together the emitter and base of the fourth current transistor to effectively increase the temperature dependence of its current to such an extent that it is made directly proportional to the absolute temperature of the circuit substrate.

In another form of the invention, the modifying resistor connects together the emitter and base of the second current transistor. With this arrangement, the temperature-dependence of the current in this latter current transistor is decreased to an extent sufficient to make the current in the current-setting resistor substantially independent of the temperature.

PREFERRED EMBODIMENT OF THE INVENTION

Figure 1:
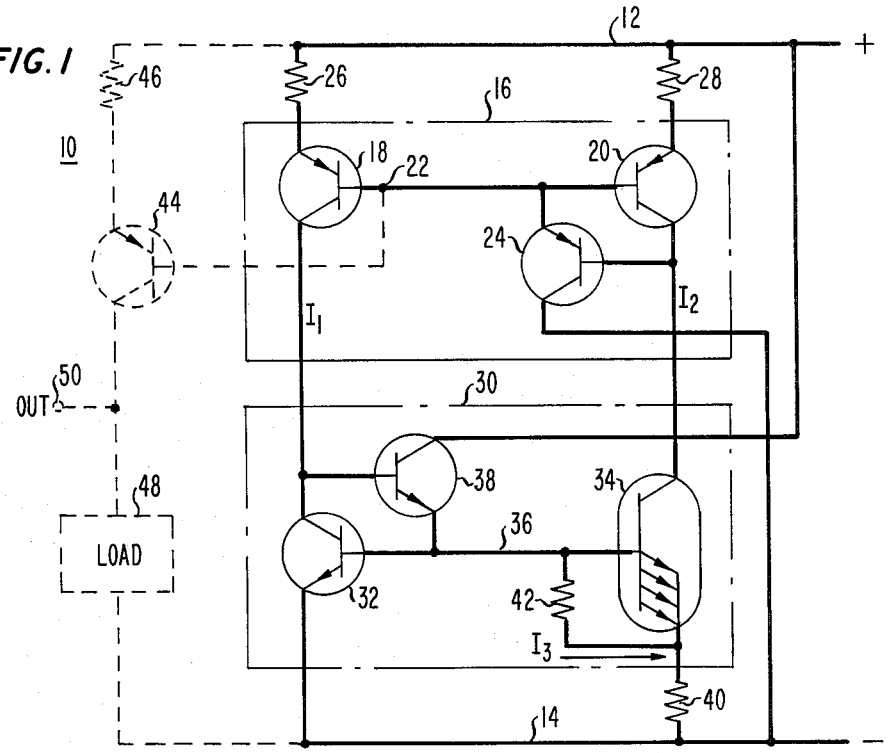
FIG. 1 shows in schematic form an integrated circuit current source in accordance with a first example of a preferred embodiment of the present invention for providing a current directly proportional to the absolute temperature.

FIG. 1 shows a preferred embodiment of a current source circuit 10 in accordance with the present invention which results in a current having a temperature coefficient proportional to the absolute temperature.

It is known to those of ordinary skill in the art of current sources that such a circuit generally has provided for it a current start-up means to provide initial current. Such a circuit feature is not necessary for an understanding of the invention and is therefore not illustrated here.

The circuit 10 of FIG. 1 has a positive power supply rail 12 and a negative power supply rail 14. A first, unity gain current mirror 16 includes a first current transistor 18 of PNP polarity and a second current transistor 20 of PNP polarity with their bases 22 connected together and tied through a first helper transistor 24 to the collector of the second current transistor 20. The first mirror 16 is connected from the emitter sides of its first and second current transistors 18, 20 to the positive supply rail 12 through emitter resistors 26, 28, respectively.

A second, temperature-responsive current mirror 30 includes third and fourth current transistors 32, 34 of NPN polarity with their bases 36 connected together and tied through a second helper transistor 38 to the collector of the third current transistor 32. The collectors of the third and fourth current transistors 32, 34 of the second mirror 30 are tied to the collectors of the first and second current transistors 18, 20 of the first mirror 16. The emitter of the third current transistor 32 is connected directly to the negative power supply rail 14, while the emitter of the current transistor 34 is connected to the negative power supply rail 14 through a current-setting resistor 40.

Although it is not fundamentally necessary to the functioning of the circuit to have both the helper transistors 24, 38, they serve to reduce errors created by the non-zero base currents of transistors 18, 20, 32 and 34.

In accordance with the present invention, a modifying resistor 42 is connected between the base and the emitter of the fourth current transistor 34.

The transistors 32, 34 of the second mirror 30 have unequal junction areas. The junction area of the output transistor 34 in this particular embodiment is about four times that of the input transistor 32. The current-setting resistor 40 has a value chosen to provide the appropriate nominal current flow in the collector of current transistor 34.

The modifying resistor 42 has a resistance-temperature characteristic similar to that of the current-setting resistor 40. The voltage across the modifying resistor 42 is the forward base-emitter junction voltage of transistor 34, which is also temperature-dependent. The modifying resistor 42 injects a temperature-dependent modifying current $I_3$ into the emitter circuit of the fourth current transistor 34 to increase the temperature dependence of the current in the collector circuit of current transistor 34.

In the operation of the current source circuit 10, the modifying current $I_3$ with a strong negative temperature coefficient of about 5000 ppm/°C., which is obtained by forcing a base-emitter voltage having a temperature coefficient of about −3000 ppm/°C. across the modifying resistor 42, is injected into the emitter of the transistor 34 to decrease its current flow. The resistance of the current-setting resistor 40 is chosen sufficiently low to provide the appropriate nominal current flow. Since the modifying current $I_3$ being subtracted has a negative temperature coefficient, the current in the current transistor 34 will have a temperature coefficient made more positive. This is consistent with the desired result of increasing the effective temperature coefficient of the current source to about +3300 ppm/°C., as is required for a temperature coefficient proportional to absolute temperature. The modifying current $I_3$ is supplied by the helper transistor 38.

There is also shown in the FIG. 1 an output stage for the current source 10. This output stage is illustrated in phantom lines, since it does not really form a part of the inventive concept. The output stage simply includes an emitter resistor 46 connected between the positive power supply rail 12 and the emitter of an output transistor 44. The collector of the output transistor 44 is connected through a load 48 to the negative power supply rail (14). An output terminal 50 is located between the collector of the transistor 44 and the load 48. Other output circuit configurations would be readily apparent to those skilled in the art of linear integrated circuits.

In addition to the output stage, there would normally be associated with the circuit 10 one of various forms of start-up circuits. The most simple form would be a high value resistor connected between the positive supply rail 12 and the collector of transistor 32 of the second current mirror 30. The start-up circuit is generally provided because the current source has as one of its possible stable states a zero current condition, which must be overcome in order to put the circuit 10 into operation. The starting circuit for a current source in accordance with the invention should be able to supply at least the base current for the helper transistor supplying the base to which the modifying resistor is tied.

The current mirror 16 of the current source 10 functions to supply the current transistors 32, 34 of the second current mirror 30 with the appropriate collector currents $I_1$, $I_2$ which are in a fixed ratio and relatively independent of the temperature or of small variations in the voltages of the supply rails 12, 14. It should be understood that there may be provided other means for establishing these collector currents $I_1$, $I_2$.

EXAMPLE 2

Figure 2:
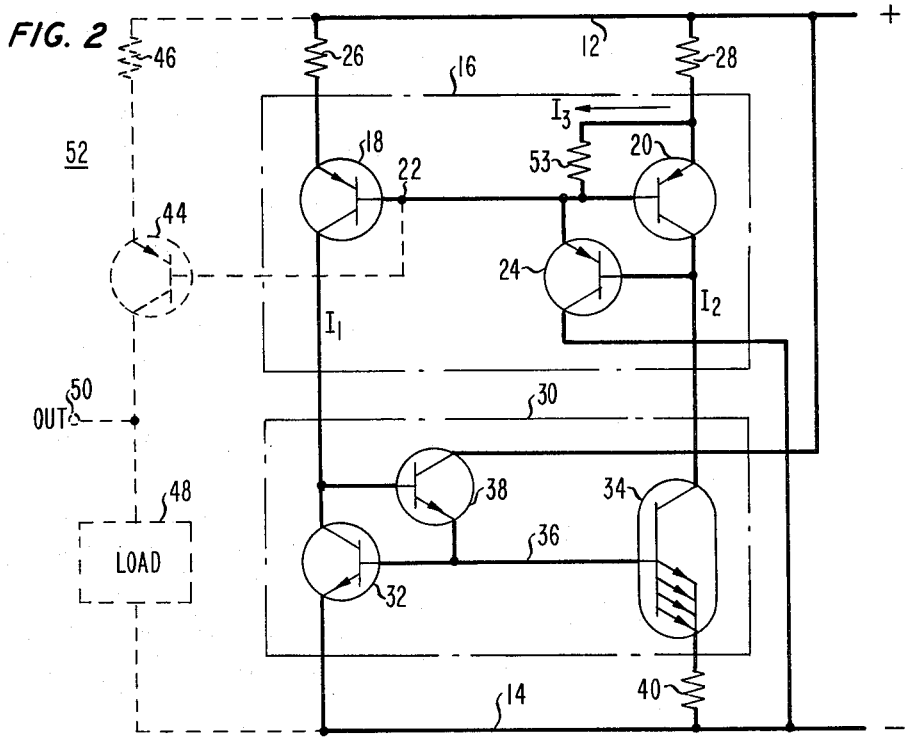
FIG. 2 shows in schematic form an integrated circuit in accordance with a second example of a preferred embodiment of the present invention for providing a current independent of the temperature.

FIG. 2 shows another embodiment of the invention in the form of a current source 52 which exhibits a zero temperature coefficient. Elements of the circuit 52 which correspond to similar elements of the circuit 10 of FIG. 1 are assigned like reference numerals. The operation of the circuit 52 is in most respects similar to that of the circuit 10 of FIG. 1. However, the current source 52 of FIG. 2 does not have the modifying resistor 42 associated with the large junction area output transistor 34. Instead, there is a modifying resistor 53 connecting the base and emitter of second current transistor 20 in the first current mirror 16. The resulting modifying current $I_3$ through the resistor 53 has a temperature coefficient of about −5000 ppm/°C. as a result of the −3000 ppm/°C. temperature coefficient of the base-emitter voltage forced across it and the +2000 ppm/°C. temperature coefficient of the modifying resistor 53. This current is injected into the emitter of the second current transistor 20 to decrease that transistor's current flow. Since the current being subtracted has a negative temperature coefficient, the remaining collector current $I_2$ will have a temperature coefficient made more positive. Current transistors 18 and 32 thus are caused to have a negative temperature coefficient relationship to the current $I_2$ flowing in the collectors of the current transistors 20 and 34. As a result, the ratio of current density of transistor 32 to that of transistor 34 is no longer constant with temperature, but rather has a negative temperature coefficient. This causes the temperature coefficient of the voltage across the current-setting resistor 40 to become less positive. If it is decreased from +3300 ppm/°C. to +2000 ppm/°C., then a zero temperature coefficient will result for $I_2$, the collector current of current transistor 34. The emitter resistor 28 may be decreased in value to return the current in the respective collector leads of current transistors 18 and 20 to equality at room temperature. If desired, the opposite correction may be obtained with a circuit 54 shown in FIG. 3 and having a modifying resistor 55 from base to emitter of the first current transistor 18 instead of the second current transistor 20. This can be made to result in a current proportional to absolute temperature as with the arrangement of FIG. 1.

Other embodiments, with other emitter area ratios and with current mirror gains other than unity, or in which other desired temperature coefficients are realized, are considered within the scope of this invention.

Figure 4:
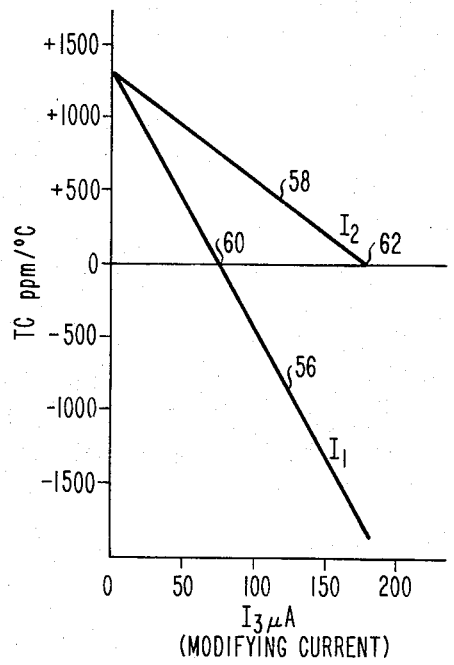
FIG. 4 is a graphical representation of the relationship between the temperature coefficient and the current $I_3$ in microamperes in the modifying resistor of the circuits of FIG. 2 at room temperature.

The effect of the modifying resistor 53 on the resultant current through the current transistors 32 and 34 is illustrated in FIG. 4 for the current source 52 of FIG. 2. In the graph, the ordinate value represents the temperature coefficient in ppm/°C., while the abscissa value represents the modifying current $I_3$ in microamperes passing through the modifying resistor 53 at room temperature. The relationship is plotted by the line 56 for $I_1$, the collector current for the smaller junction area current transistor 32 of the second mirror 30, and is also plotted by the line 58 for $I_2$, the collector current for the larger junction area current transistor 34 of the second mirror 30.

It is evident from FIG. 4 that various current relationships can be obtained by appropriate choices of values for the modifying resistor 53 and current-setting resistor 40. For example, these values can be chosen so that either the collector current of the third current transistor 32 or the collector current of the fourth current transistor 34 is relatively independent of the absolute temperature. The former of these conditions is represented on the diagram of FIG. 4 by the point 60, while the latter is represented by the point 62. Alternatively, the resistance values can be chosen so that it is the sum of the collector currents $I_1$, $I_2$ which is substantially independent of the temperature. The actual numerical values for the current-setting resistor and for the modifying resistor depend upon the nature of the particular components and the specific application of the circuit and can be readily determined by one of ordinary skill in the art of integrated circuit design without the necessity of undue experimentation.

Figure 3:
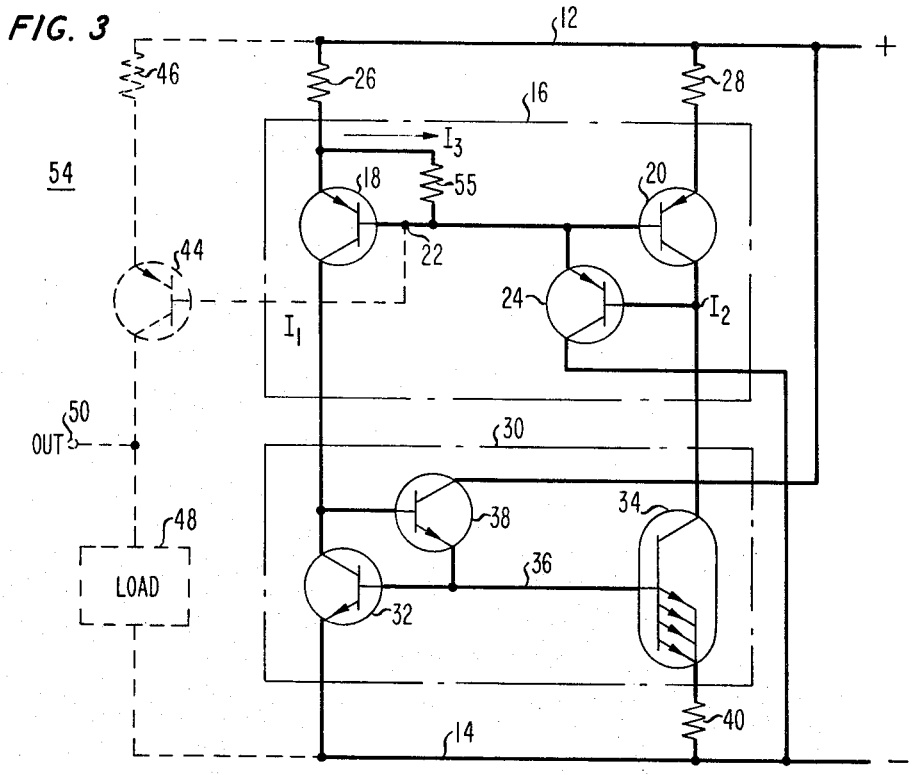
FIG. 3 shows in schematic form an integrated circuit in accordance with a third example of a preferred embodiment of the present invention for providing a current directly proportional to the absolute temperature.

While in the current sources 10, 52, 54 of FIGS. 1, 2, and 3, respectively, the collector currents of the transistors 32, 34 of the temperature-sensitive second current mirror 30 were established by a unity-gain current mirror 16, this is not a necessary condition for the current source in accordance with the invention. It is only necessary to somehow establish collector currents for the current transistors 32, 34 which will result in an appropriate ratio of different current densities in these transistors 32, 24. Such a condition can, of course, be achieved with numerous other choices of gain in the mirror 16 and a corresponding appropriate choice of relative junction areas in the transistors 32, 34 of the mirror 30.

The helper transistors 24, 38 serve to reduce errors created by the non-zero base currents of the transistors 18, 20, 32, and 34. These errors are of limited significance, except where there is direct influehce by the presence of a modifying resistor, such as the resistor 42, 53, or 55 in the FIGS. 1, 2, and 3. Therefore, for the current source of 10 of FIG. 1, the helper transistor 24 is not essential, while for the current source 52 of FIG. 2, the helper transistor 38 is not essential.

I claim:

1. An apparatus (10, 52, 54) for generating a controlled current, comprising:

a first current mirror (16) having first and second current transistors (18, 20) of a first junction polarity, each with a base, an emitter, a collector, and a conductive junction area, the emitters being connected through first and second emitter resistors (26, 28) to a first supply voltage means (12);

a second current mirror (30) having third and fourth current transistors (32, 34) of a second junction polarity, opposite to the first polarity, each with a base, an emitter, a collector, and a conductive junction area, the collectors of the first and second current transistors (18, 20) being connected to the collectors of the third and fourth current transistors (32, 34), respectively, to regeneratively couple the first and second current mirrors (16, 30) so that the conductive junction areas of the third and fourth current transistors (32, 34) have unequal current densities, the emitter of the third current transistor (32) being connected to a second supply voltage means (14); and a current-setting resistor (40) connecting the emitter of the fourth current transistor (34) to the second supply voltage (14); characterized by a modifying resistor (42, 53, 55) connecting together the base and emitter of one of the first (18), second (20), or fourth (34) current transistors and passing a temperature-dependent modifying current for modifying the temperature dependence of the collector current of the fourth current transistor (34).

2. The apparatus (10, 52, 54) according to claim 1, wherein the conductive junction areas of the third and fourth current transistors (32, 34) are unequal to each other.

3. The apparatus (10, 52, 54) according to claim 2, wherein the current-setting resistor (40) and the modifying resistor (42, 53, 55) have similar inherent temperature characteristics.

4. The apparatus (10) according to claim 3, wherein the modifying resistor (42) connects together the base and the emitter of the fourth current transistor (34) to effectively increase the temperature dependence of the resultant current in the fourth current transistor (34).

5. The apparatus (10) according to claim 4 and comprising a modifying current helper transistor (38) for supplying the temperature-dependent current of the modifying resistor (42), the helper transistor (38) having the second junction polarity and having a collector connected to the first supply voltage means (12), an emitter connected to the bases of the third and fourth current transistors (32, 34) and a base connected to the collector of the third current transistor (32).

6. The apparatus (10) according to claim 5, wherein the resistance value of the modifying resistor (42) is chosen so that the resulting collector current in the fourth current transistor (34) is proportional to the absolute temperature of the apparatus (10).

7. The apparatus (10) according to claim 6, wherein the first mirror (16) has a unity gain.

8. The apparatus (10) according to claim 7 and comprising a base current helper transistor (24) for supplying base current to the first and second current transistors (18, 20), the base current helper transistor (24) having the first junction polarity and having a collector connected to the second supply voltage means (14), an emitter connected to the bases of the first and second current transistors (18, 20), and a base connected to the collector of the second current transistor (20).

9. The apparatus (52) according to claim 3, wherein the modifying resistor (53) connects together the base and emitter of the second current transistor (20) to reduce the temperature dependence of the resultant collector current in the fourth current transistor (34).

10. The apparatus (52) according to claim 9 and comprising a modifying current helper transistor (24) for supplying the temperature-dependent current in the modifying resistor (53), the helper transistor (24) having the first junction polarity and having an emitter connected to the bases of the first and second current transistors (18, 20), a collector connected to the second supply voltage means (14), and a base connected to the collector of the second current transistor (20).

11. The apparatus (52) according to claim 10, wherein the current-setting resistor (40) and the modifying resistor (53) have resistance values chosen so that the resultant collector current in the fourth current transistor (34) is substantially independent of the temperature of the apparatus (10).

12. The apparatus (52) according to claim 11 and comprising a base current helper transistor (38) for supplying base current to the third and fourth current transistors (32, 34), the base current helper transistor (38) having the second junction polarity and having a collector connected to the first supply voltage means (14), an emitter connected to the bases of the third and fourth current transistors (32, 34), and a base connected to the collector of one of the third current transistor (32).

* * * * *